United States Patent [19]

Dyck et al.

[11] Patent Number: 4,498,011

[45] Date of Patent: Feb. 5, 1985

[54] DEVICE FOR RECEIVING, MOVING AND RADIATION-SHIELDING OF VESSELS FILLED WITH EXPENDED REACTOR FUEL ELEMENTS

[75] Inventors: Hans P. Dyck, Burgdorf; Klaus Janberg, Ratingen; Wolfgang Richter, Laatzen; Harry Spilker, Graben-Neudorf, all of Fed. Rep. of Germany

[73] Assignee: Deutsche Gesellschaft fur Wiederaufarbeitung, Fed. Rep. of Germany

[21] Appl. No.: 261,750

[22] Filed: May 8, 1981

[30] Foreign Application Priority Data

May 9, 1980 [DE] Fed. Rep. of Germany ..... 3017767

[51] Int. Cl.[3] ..... G21F 5/00

[52] U.S. Cl. ..... 250/507.1

[58] Field of Search ..... 250/506.1, 507.1, 515.1; 376/272

[56] References Cited

U.S. PATENT DOCUMENTS

| | | | |
|---|---|---|---|
| 1,576,535 | 3/1926 | Muir | 250/506.1 X |
| 3,005,105 | 10/1961 | Lusk | 250/506.1 |
| 3,111,586 | 11/1963 | Rogers | 250/507.1 |
| 3,391,280 | 7/1968 | Bonilla et al. | 250/506.1 |
| 3,731,102 | 5/1973 | Peterson | 250/506.1 |
| 4,257,912 | 3/1981 | Fleischer et al. | 250/506.1 X |
| 4,291,536 | 9/1981 | Girard | 250/506.1 X |

FOREIGN PATENT DOCUMENTS

| | | | |
|---|---|---|---|
| 1078701 | 3/1960 | Fed. Rep. of Germany | 250/506.1 |
| 1146209 | 3/1963 | Fed. Rep. of Germany | 250/506.1 |

OTHER PUBLICATIONS

Nelson et al., "Retrievable Surface Storage . . . ", *Nuclear Technology*, vol. 24, Dec. 1974, pp. 391–397.

*Primary Examiner*—Alfred E. Smith
*Assistant Examiner*—Jack I. Berman
*Attorney, Agent, or Firm*—Allegretti, Newitt, Witcoff & McAndrews, Ltd.

[57] ABSTRACT

The invention concerns a device for the receiving, moving and radiation-shielding of vessels filled with expended reactor fuel elements. The device consists of a protective container having a base, a cylindrical protective jacket and a cover made from concrete. At the lower rim of the jacket there are lateral air ducts which open into the annular space between protective jacket and fuel element vessel. In the area of the upper jacket edge, lateral air outlet ducts are provided. For facilitating the loading of the device with fuel element containers and its transportation, the base is constructed in the form of a separate movable pallet. The fuel element container can be placed on this pallet, and the protective jacket over it. The air outlet ducts in the area of the cover are arranged in an inclined or angular fashion. The base is provided with a raised center platform for supporting the fuel element vessel. Also, centering means is provided for the correct seating of the protective jacket with respect to the base.

1 Claim, 4 Drawing Figures

DEVICE FOR RECEIVING, MOVING AND RADIATION-SHIELDING OF VESSELS FILLED WITH EXPENDED REACTOR FUEL ELEMENTS

The invention relates to a device for enclosing and shielding a vessel filled with expended reactor fuel elements, including means for cooling the vessel and for supporting the vessel for transporting same.

PRIOR ART

A protective concrete container of this general type is described in "Nuclear Technology", Vol. 24, p. 391–397, December 1974. This known prior container is provided with an integral bottom plate serving as the container floor. The concrete cover member is formed separately. Laterally arranged at or near the bottom of the container are air inlet openings, and at or near the container top are air outlet openings. No means are disclosed for the lifting or transportation of the concrete container, nor are measures proposed to prevent water or vermin, for example insects, from entering. Furthermore, no provision is made to improve the heat discharge and to possibly recover at least a part of the heat generated.

A similar container has been described in the publication ARH-2888 REV, p. 2–13. This container apparently consists of a separate concrete shielding jacket, a concrete base and a concrete cover. Both the concrete cover and the concrete base are positioned in spaced relation to the protective concrete jacket. Due to this particular design, air inlet openings are created at the bottom and air outlet openings are created in the proximity of the container top. This prior protective concrete container likewise fails to make provision for lifting and transportation, for preventing ingress of water and vermin, or for improving the heat discharge and a possible recovery of at least some of the heat generated.

THE INVENTION

It is the object of the present invention to produce a protective container for a vessel filled with radioactive material which overcomes the disadvantages of the prior art devices referred to above, and in particular to improve the loading operation and transportation of the device.

This is accomplished by providing a base for the protective container which also serves as a movable pallet, and inclined air discharge ducts in the region of the container cover. The insertion of a fuel element vessel into the container of the present invention is accomplished by first setting the fuel element vessel upon the base, then placing the protective jacket over the fuel element vessel, and, finally, putting the cover member into position. By constructing the base in the form of a movable pallet, the lifting and transportation of the protective container is considerably facilitated. To move the concrete container, a low bed vehicle may be used to advantage because in view of its flat low construction, it is capable of being moved with its loading platform underneath the pallet. The loading platform is then raised vertically and the protective container is moved in an upright position to the intended storage location where it is unloaded simply by lowering the loading platform of the vehicle. Due to the inclined and/or angular configuration of the air discharge ducts in the area of the cover member, the ventilation and thus the heat discharge is improved.

The vessels filled with spent fuel elements still have on their outer surfaces a radioactive dosage rate of gamma and neutron radiation of approximately 10 milliroentgen/hr, with one year decay time. By the shielding means installed in the protective container according to the invention, the radiation dosage rate is lowered to a level such that at a distance of 50 meters, i.e. approximately by the fencing of the container storage site, the radiation rate will only be about 10 milliroentgen/yr.

In one embodiment of the invention the highest points of the air discharge ducts are at an elevation higher than the air inlet openings and at the same height or higher than the air outlet openings. This enhances the chimney effect with the result that the heat discharge is improved. Due to this particular configuration of the air discharge ducts, neutron and gamma ray streaming is reduced with the result that reflection of the radiated particles by air molecules, causing so-called sky-shine effects, is minimized. Finally, this embodiment of the invention is capable of preventing rain or snow from entering, to a large extent.

In a preferred embodiment, a cover in the form of a hood with a downturned flange provides improved protection against water, snow and insects and, in the process, reduces the danger of radioactive contamination occurring outside the protective container.

In another embodiment which includes a water-cooled cover, shielding and heat discharge of the container device of the invention are improved. In addition, this embodiment is capable of utilizing the generated heat, for example for heating purposes. Water may be introduced in the lower region of the closure member, i.e. cover or hood, and discharged from the upper region. The cooling effect thus produced enables the concrete to absorb more heat from the fuel element vessel due to radiation and cross convection. In this particular construction, the normally-occurring convection loses significance, permitting the air discharge ducts to be designed and dimensioned, especially narrowed, in such a manner that the convection air current is diminished without jeopardizing the safety of the heat discharge process. Consequently, the water temperature can be raised to a level which permits a still better heat utilization. In the event of a breakdown in the water circulation, the container temperature would be raised only about 40° to 60° C. and would thus remain within the permissible limits.

The ventilation of the protective container may be further improved by means of additional axially-extending air supply openings in the base.

To ensure that the protective container is placed properly upon the base or pallet, respectively, boss means are provided for positioning the container with respect to the base.

To prevent vermin and insects from entering the container, screens or grids may be provided in the air inlet and outlet openings.

THE DRAWINGS

The invention will now be described in further detail with reference to the accompanying drawings, which illustrate an exemplary embodiment of the invention, and in which.

DETAILED DESCRIPTION

Figure 1:
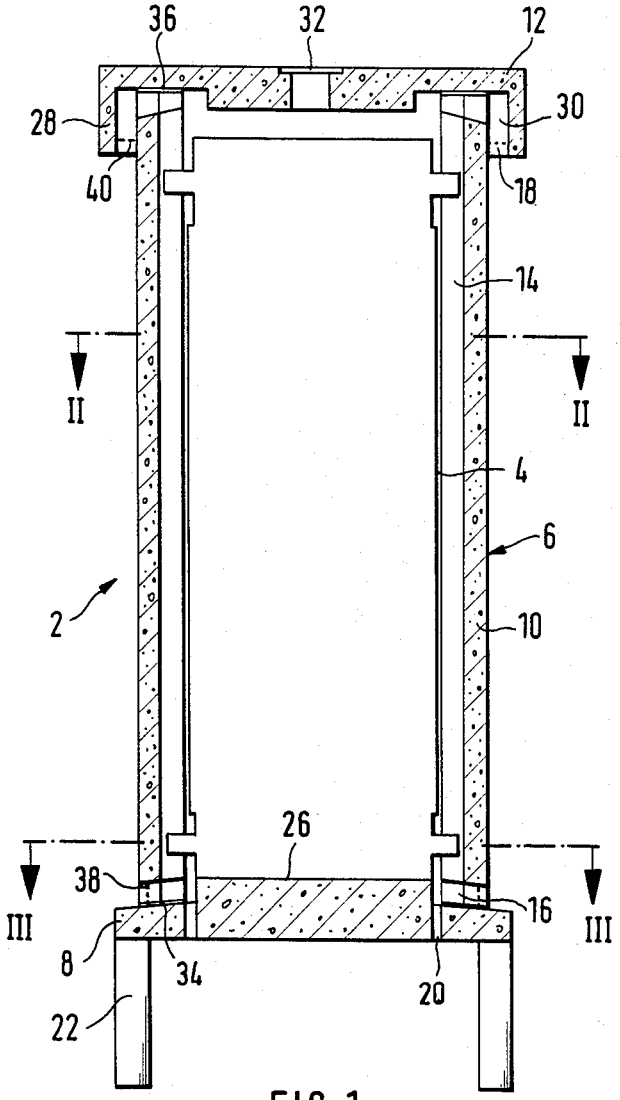
FIG. 1 is an elevational sectional view of the protective container of the invention.
Figure 2:
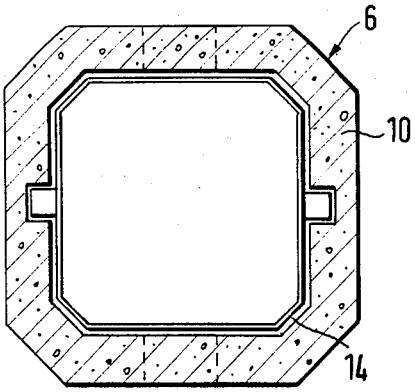
FIG. 2 is a cross section along the line II—II of FIG. 1.
Figure 3:
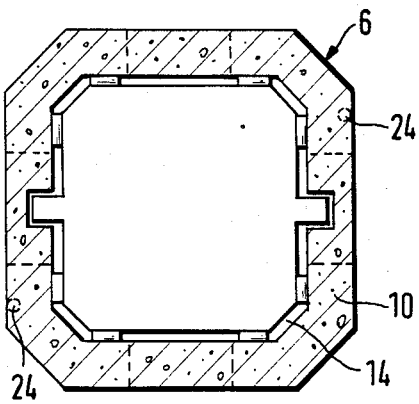
FIG. 3 is a cross section along the line III—III of FIG. 1.

FIGS. 1 to 3 illustrate a container or device 2 for receiving, moving and radiation shielding of vessels 4 filled with spent reactor fuel elements. The device 2 comprises a protective container 6 having a base 8, a protective cylindrical jacket or shield 10 and a cover 12. These structural components of the device 2 are preferably made of concrete.

The interior periphery of the protective container 6 is slightly larger than the perimeter of the vessel 4 holding the fuel elements so that an annular clearance 14 is formed in which air is permitted to circulate.

The protective container 6 is provided on each side near its bottom portion with air inlet ducts 16 and near its top portion with air outlet ducts 18. The ducts 16 and 18 are in communication with the annular space 14. The base 8 is further provided with axially extending air supply channels 20 which likewise open into the annular space 14.

The base 8 is constructed in the form of a pallet capable of being moved on legs 22. Placed upon the base 8, or pallet, is the protective jacket 10. For proper location of the jacket 10 on the base 8, centering pins 24 are provided, as shown in FIG. 3. The base or pallet 8 has a raised center portion 26 to receive the fuel element vessel 4.

The cover 12 is constructed approximately in the shape of a hood having a peripheral downwardly extending collar 28 surrounding the protective jacket 10 in spaced relation. The annular space 30 thus formed is open to the atmosphere and in communication with the air discharge ducts 18. The cover 12 has an upper opening 32 for inspection purposes which is adapted to be closed.

Seals 34 are provided between the abutting surface areas of the concrete jacket 10 and the base 8, and seals 36 are provided between the abutting areas of the concrete jacket and the cover. The air inlet ducts 16 and the air outlet ducts 18 are provided with narrow mesh grids 38, 40 to keep vermin and insects out.

The protective container 6 is preferably of a polygonal cross section, as shown in FIGS. 2 and 3. Other cross-sectional configurations, such as, for instance, circular, oval or rectangular, are also feasible.

Figure 4:
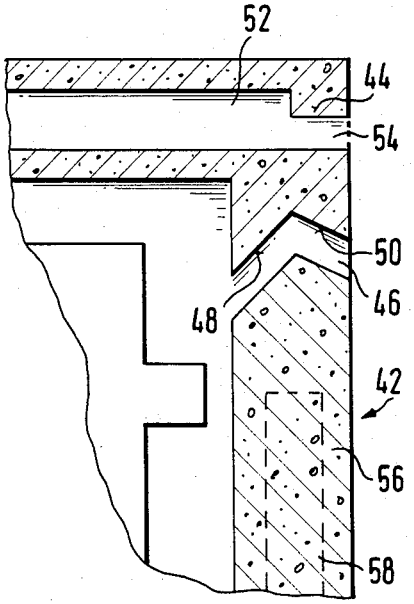
FIG. 4 is a sectional view of another embodiment of the closure member of the protective container.

FIG. 4 shows a schematic cross-sectional partial view of another embodiment of the invention comprising a protective container 42 having, in particular, a differently-constructed cover 44 and differently-shaped air outlet ducts 46. The configuration of the air outlet ducts 46 is such that a first section 48 rises or slopes upwardly and, at the vertex of the angular duct, a section 50 falls or slopes outwardly in a slightly downward direction. Alternatively the second section 50 of the air discharge duct 46 may extend horizontally. The cover in the shape of a hood 44 is provided with a hollow space 52 adapted to be connected to a water circulation system by input means 54 and output means, not illustrated. The heated water discharged from the space 52 may be passed through the coil over which air may be blown for heating purposes, as is well known.

The cover or hood 44 is preferably provided with center opening, not shown, for inspection purposes, in similar fashion as the cover 12 of FIG. 1. Like the cover 44, the jacket 56 may also be provided with hollow internal spaces 58 for the circulation of water, as indicated by broken lines in FIG. 4.

It is to be understood that the embodiment of the invention which has been described is merely illustrative of one application of the principles of the invention. Numerous modifications may be made to the disclosed embodiment without departing from the true spirit and scope of the invention.

What is claimed is:

1. A device for receiving, moving, and radiation shielding of vessels filled with expended reactor fuel elements, comprising a protective concrete container having a base; a cylindrical protective jacket, the inner diameter of which is somewhat greater than the diameter of the vessel holding the fuel elements to provide an annular space therebetween; a cover; lateral air inlet ducts at the lower rim of the jacket in communication with the atmosphere and said annular space; and lateral air outlet ducts in the region of the upper rim of the jacket below the cover in communication with the atmosphere and said annular space, characterized in that said base consists of a movable pallet separate from said jacket having a central platform for supporting said fuel element vessel, said jacket resting upon the margin of said base surrounding said platform, said base carries centering means to properly position said jacket on said base, and is supported by legs to permit underrun for lifting, said air outlet ducts have two inclined segments joined at an apex within the wall of said jacket, an inner segment opening into said annular space and an outer segment opening to the atmosphere, said inner segment being longer than and extending below said outer segment, said cover is in the form of a hood having a downwardly-turned flange spaced from and surrounding said jacket and extending below said outlet ducts.

* * * * *